US008801640B2

(12) United States Patent
Sevy et al.

(10) Patent No.: US 8,801,640 B2
(45) Date of Patent: Aug. 12, 2014

(54) ADJUSTABLE REHABILITATION SYSTEM AND METHOD

(71) Applicants: John M. Sevy, Owensboro, KY (US); Jeffery Allen Morris, Henderson, KY (US)

(72) Inventors: John M. Sevy, Owensboro, KY (US); Jeffery Allen Morris, Henderson, KY (US)

( * ) Notice: Subject to any disclaimer, the term of this patent is extended or adjusted under 35 U.S.C. 154(b) by 0 days.

(21) Appl. No.: 13/747,519

(22) Filed: Jan. 23, 2013

(65) Prior Publication Data

US 2013/0197403 A1 Aug. 1, 2013

Related U.S. Application Data

(60) Provisional application No. 61/592,831, filed on Jan. 31, 2012.

(51) Int. Cl.
*A61H 1/02* (2006.01)
*A63B 21/00* (2006.01)

(52) U.S. Cl.
USPC ..... 601/34; 601/24; 601/5; 482/131

(58) Field of Classification Search
USPC ..... 601/23, 24, 27, 45, 5, 33–35; 482/52, 482/907, 148, 145, 125, 130, 135–137, 122, 482/124, 131; 606/240–245; 602/32, 33, 602/35, 36, 38, 40
See application file for complete search history.

(56) References Cited

U.S. PATENT DOCUMENTS

| | | | | |
|---|---|---|---|---|
| 3,664,666 | A * | 5/1972 | Lloyd | 482/133 |
| 4,492,222 | A | 1/1985 | Hajianpour | |
| 4,508,335 | A * | 4/1985 | Kelley et al. | 482/140 |
| 5,025,802 | A * | 6/1991 | Laico et al. | 128/882 |
| 5,286,242 | A | 2/1994 | Johnston | |
| 5,318,347 | A * | 6/1994 | Tseng | 297/411.36 |
| 5,403,258 | A * | 4/1995 | Hill | 482/142 |
| 5,545,114 | A * | 8/1996 | Gvoich | 482/140 |
| 5,647,823 | A | 7/1997 | Spence | |
| 5,957,876 | A * | 9/1999 | D'Amico | 602/33 |
| 6,726,642 | B2 * | 4/2004 | Danielsson et al. | 602/5 |
| 7,217,228 | B2 * | 5/2007 | Marquez | 482/130 |
| 7,611,450 | B2 * | 11/2009 | Mancini | 482/130 |
| 2004/0049135 | A1 * | 3/2004 | Callanan et al. | 601/33 |
| 2008/0182730 | A1 * | 7/2008 | Conley et al. | 482/95 |
| 2009/0204033 | A1 * | 8/2009 | Shelbourne et al. | 601/5 |
| 2010/0152003 | A1 | 6/2010 | Haas | |
| 2011/0034307 | A1 | 2/2011 | Eddy | |

* cited by examiner

*Primary Examiner* — Valerie L Skorupa

(57) ABSTRACT

An adjustable stretching system for stretching a leg of a user comprises a base, an adjustable elevation board configured to be adjustable in length, a seat cushion attached to the base, and a cushioned platform connectable to the base. The adjustable elevation board may be configured to be connected between the base and the cushioned platform.

6 Claims, 3 Drawing Sheets

ADJUSTABLE REHABILITATION SYSTEM AND METHOD

REFERENCE TO RELATED APPLICATION

This application claims the benefit of U.S. Provisional Patent Application No. 61/592,831, filed Jan. 31, 2012, entitled "Adaptable Rehabilitation Device."

BACKGROUND OF THE INVENTION

The present invention relates to an adaptable rehabilitation device to allow one, independently, to perform multiple exercises following knee surgery. Following knee surgery, it is difficult for a patient to effectively exercise independently at home. For many of the exercises to be effective, the patient is dependent upon another person and a specific set up within their home environment.

Current devices do not allow for a gravity assisted knee flexion stretching. They do not allow for knee flexion self stretching in the reclined position. Current devices do not allow for self stretching for both knee flexion and extension in the reclined or semi-reclined position. The current knee range of motion devices are not adaptable to encompass other important knee rehabilitation exercises. The current knee flexion self stretching devices do not stabilize the thigh/hip position, thus not ensuring a safe and true knee flexion angle of movement.

As can be seen, there is a need for solutions to these and other problems.

SUMMARY OF THE INVENTION

In one aspect of the present invention, an adjustable stretching system for stretching a leg of a user comprises: a base; an adjustable elevation board configured to be adjustable in length; a seat cushion attached to the base; and a cushioned platform connectable to the base, wherein the adjustable elevation board is configured to be connected between the base and the cushioned platform.

In one aspect, the system further comprises: a first padded interface configured to interface with a first leg region of the user just below a knee of the user; a second padded interface configured to interface with a second leg region of the user just above a knee of the user; a first cabling connected to the first padded interface and configured to be pulled by the user; a second cabling connected to the second padded interface and configured to be pulled by the user; and an ankle pad connectable to the base and configured to support an ankle of the user when the first and second padded interfaces are interfacing with the first and second leg regions, respectively, of the user.

In one aspect, the system further comprises: a padding connectable to the elevation board; a padded interface configured to interface with a lower leg region of the user; and a cabling connected to the padded interface and configured to be pulled by the user.

In one aspect, the system further comprises a foot sling stretchably connected to the base and configured so that when a foot of the user is in the foot sling and the user pulls the cabling, the foot sling resists pulling by the user. In one aspect, the system further comprises a brace connected to the base and configured to support the elevation board in a substantially vertical position. In one aspect, the system further comprises a step-up platform connectable to the base and comprising a plurality of independently connectable platform units.

In one aspect, the adjustable elevation board comprises at least a first elevation board and a second elevation board slidably connected to each other and configured to be locked relative to each other.

In one aspect, a method of stretching the leg of the user comprises: providing the adjustable stretching system as described; connecting the elevation board to the base; connecting the cushioned platform to the base and the elevation board; adjusting the elevation board so as to adjust an angle of inclination of the cushioned platform; resting a posterior of the user on the seat cushion and resting the leg of the user on the cushioned platform.

In one aspect, an adjustable stretching system for stretching a leg of a user comprises: a base; an adjustable elevation board configured to be adjustable in length; a seat cushion attached to the base; a padding connectable to the elevation board; a padded interface configured to interface with a lower leg region of the user; and a cabling connected to the padded interface and configured to be pulled by the user.

In one aspect, the system further comprises a foot sling stretchably connected to the base and configured so that when a foot of the user is in the foot sling and the user pulls the cabling, the foot sling resists pulling by the user. In one aspect, the system further comprises a brace connected to the base and configured to support the elevation board in a substantially vertical position. In one aspect, the system further comprises a step-up platform connectable to the base and comprising a plurality of independently connectable platform units.

In one aspect, the adjustable elevation board comprises at least a first elevation board and a second elevation board slidably connected to each other and configured to be locked relative to each other.

In one aspect, a method of stretching the leg of the user comprises: providing the adjustable stretching system as described; connecting the elevation board to the base; connecting the padding to the elevation board; adjusting the elevation board so as to adjust a height of the padding; resting a posterior of the user on the seat cushion and draping the leg of the user over the elevation board so that the leg is supported by contact of the padding against an opposing region of a knee of the user; interfacing the padded interface with the lower leg region of the user; and pulling the cabling so as to stretch the leg at the knee.

In one aspect, the system further comprises: a first padded interface configured to interface with a first leg region of the user just below a knee of the user; a second padded interface configured to interface with a second leg region of the user just above a knee of the user; a first cabling connected to the first padded interface and configured to be pulled by the user; a second cabling connected to the second padded interface and configured to be pulled by the user; and an ankle pad connectable to the base and configured to support an ankle of the user when the first and second padded interfaces are interfacing with the first and second leg regions, respectively, of the user. In one aspect, a single cabling comprises the first cabling and the second cabling.

In one aspect, a method of stretching the leg of the user comprises: providing the adjustable stretching system as described; resting a posterior of the user on the seat cushion and resting the ankle on the ankle pad; interfacing the first padded interface with the first leg region; interfacing the second padded interface with the second leg region; and pulling the single cabling to thereby stretch the leg at the knee.

These and other features, aspects and advantages of the present invention will become better understood with reference to the following drawings, description and claims.

DETAILED DESCRIPTION OF THE INVENTION

Figure 1:
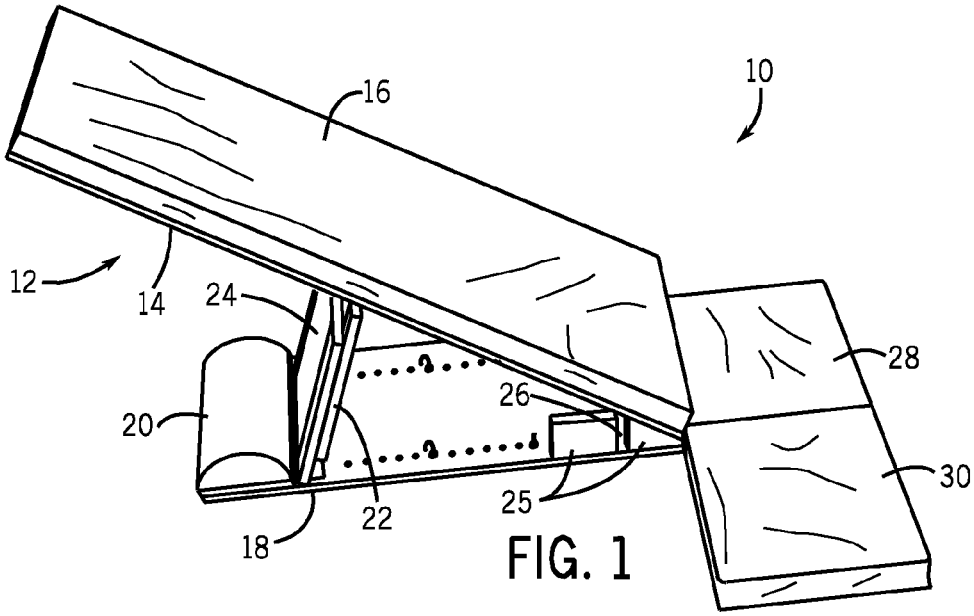
FIG. 1: is a perspective view of a first configuration of the invention in use.
Figure 2:
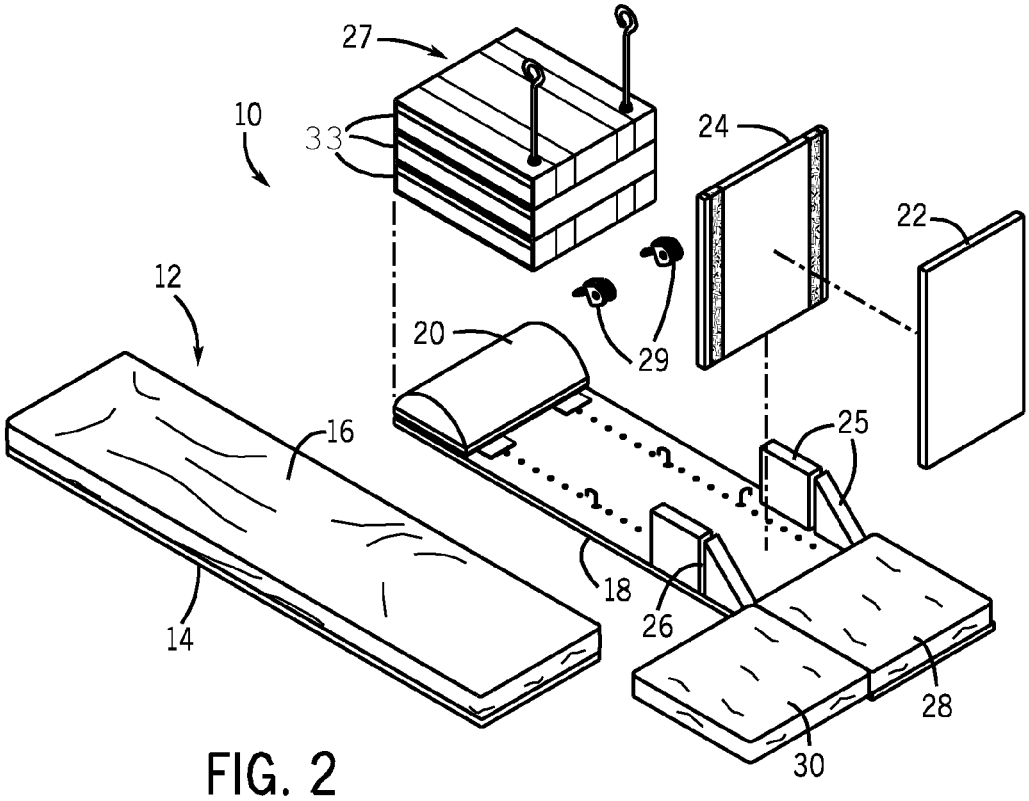
FIG. 2: is an exploded perspective view of the components of FIG. 1.
Figure 3:
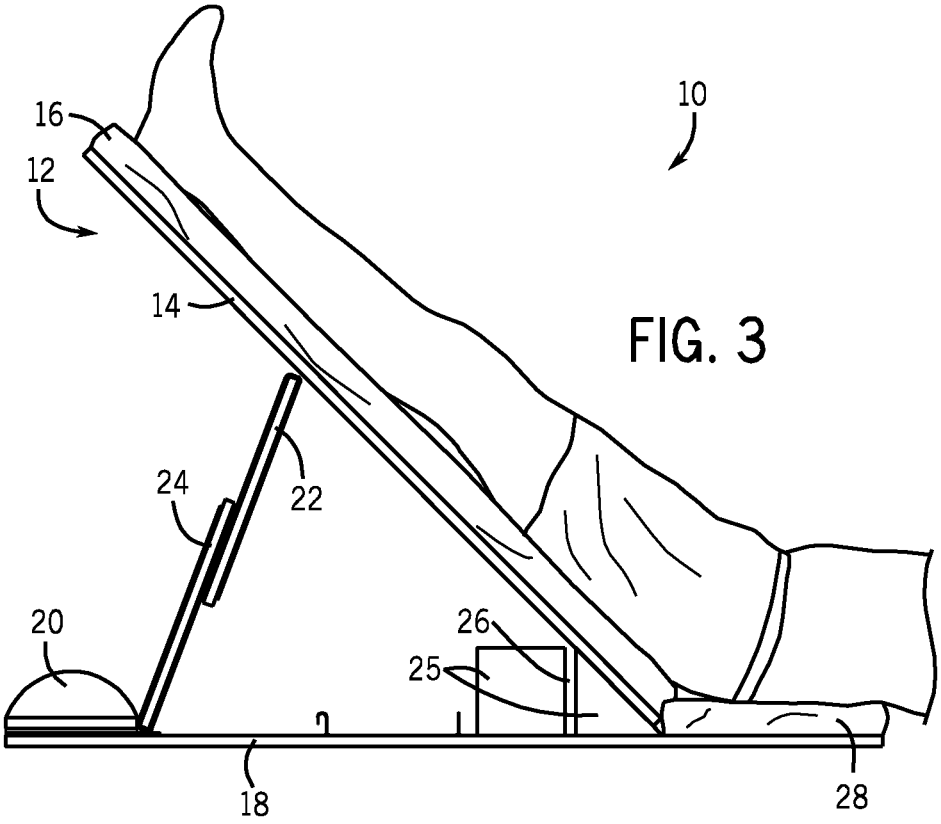
FIG. 3: is a side elevation view showing the first configuration of the invention in use.
Figure 4:
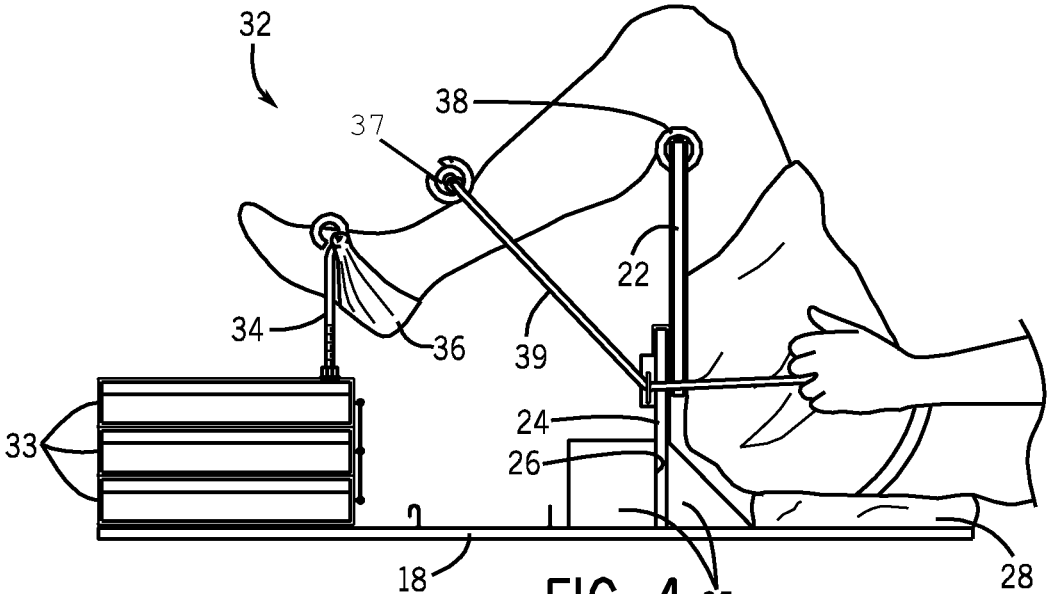
FIG. 4: is a side elevation view of a second configuration of the invention.
Figure 5:
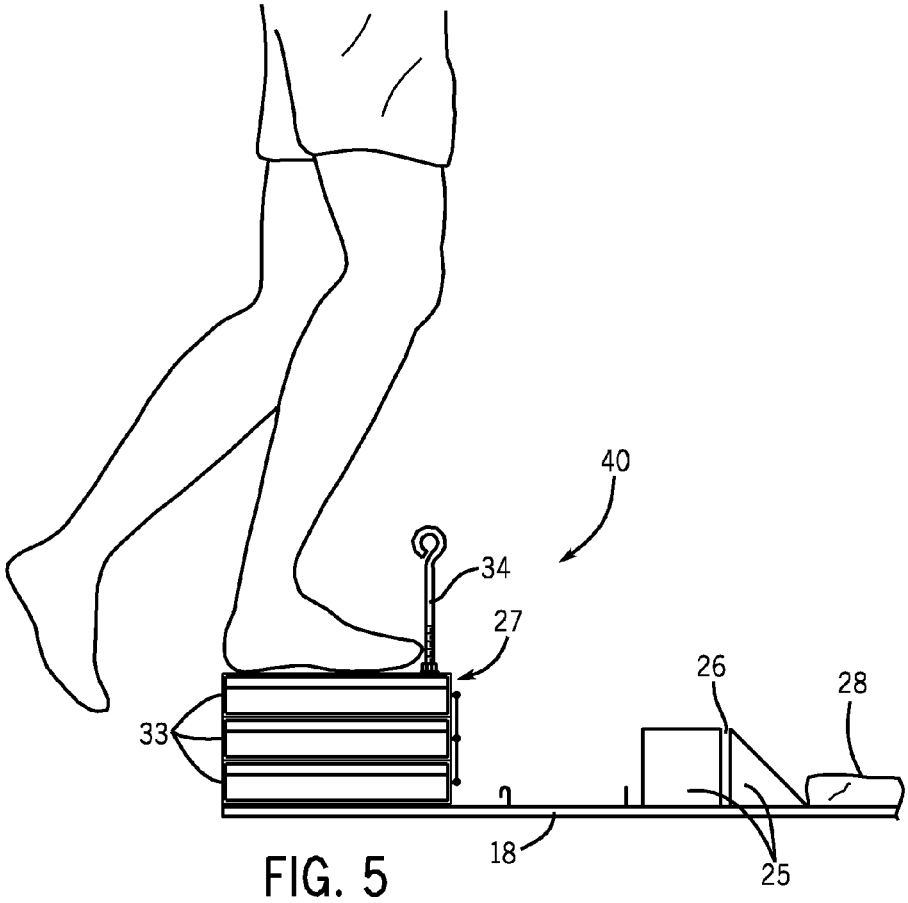
FIG. 5: is a side elevation view of a third configuration of the invention.
Figure 6:
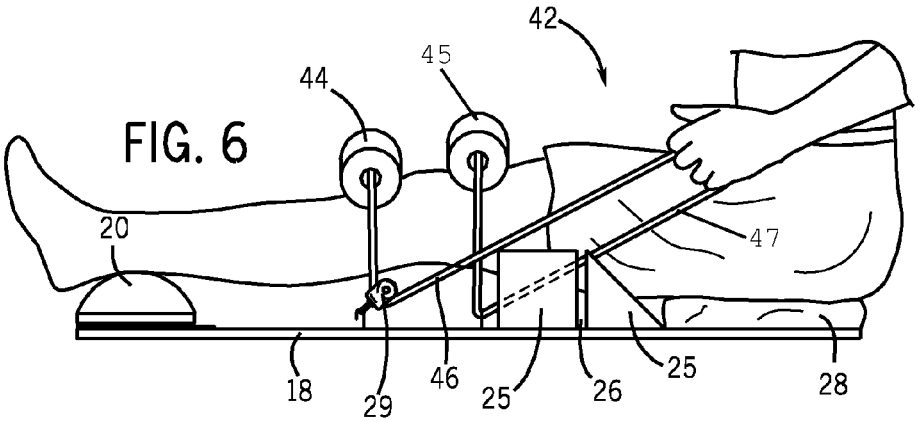
FIG. 6: is a side elevation of a fourth configuration of the invention.

The following detailed description is of the best currently contemplated modes of carrying out exemplary embodiments of the invention. The description is not to be taken in a limiting sense, but is made merely for the purpose of illustrating the general principles of the invention.

Referring now to the figures, the following reference numbers may refer to elements of the invention:

10: is the overall first configuration of the rehabilitation device invention.

12: is the slant board unit

14: is the cushioned platform of unit 12.

16: is the cushion of unit 12.

18: is the base.

20: is the half-round foam roll or ankle pad.

22: is a first elevation board.

24: is a second elevation board.

25: are vertical braces.

26: are spaces between braces 25, allowing for insertion of second elevation board 24.

27: is the step-up platform.

28: is a seat cushion.

29: are the pulleys.

30: is a second seat cushion.

32: is the overall second configuration of the invention.

33: are the platform units.

34: is the vertical eye bolt.

36: is the foot sling.

37: is a padded interface

38: is a padding.

39: is a cabling.

40: is the overall third configuration of the invention.

42: is the overall fourth configuration of the invention.

44: is a first padded interface.

45: is a second padded interface

46: is a first cabling.

47: is a second cabling.

The present invention allows for a spectrum of self stretching knee flexion and extension force from gentle gravity assisted to as forceful as the patient can impart through the present pulley system. This is able to be performed in a reclined position to facilitate relaxation/comfort, and with the thigh supported to ensure a more true-knee flexion angle of movement, making it safer to use. The present invention is easily adaptable to allow user to perform hamstring strengthening, progressive step-up exercises, and 45 degree elevation/icing. These are all important home rehabilitation activities that require user to have assistance or a special set up within their home environment. The present invention makes these exercise/activities easier for the user to perform by decreasing users' dependence upon someone else for assistance or requiring special set up within the user's home environment.

The present invention allows one to effectively stretch both knee flexion and extension in a reclined position. The present invention also empowers one to stretch through a broad spectrum of force from gentle gravity assisted to forceful over pressure. Our flexion component also stabilizes the femur ensuring a normal movement at the knee.

The present invention will allow the post-operative knee surgery patient to independently and effectively perform range of motion for knee flexion and knee extension, both gravity assisted and with overpressure for appropriate and tolerable stretching. The device will also adapt simply to allow hamstring strengthening, progressive step-up exercises and elevation for icing, all of which traditionally require the assistance of another person and/or special set up within patients' home environment.

This invention is an improvement on what currently exists. Currently, devices are limited to either flexion or extension of the knee, or are unable to be performed in a reclined position to capitalize on a gentle gravity-assisted stretch, and do not incorporate the value of a strengthening component. Also, the current devices do not encompass adaptability to provide other necessary components of post-operative independent home knee rehabilitation. The present invention allows gravity assisted or independently controlled overpressure to effectively stretch both knee flexion and extension in the reclined or semi-reclined position. This device is also easily adaptable to facilitate independent lower extremity strengthening and icing/elevation of the lower extremity. This device would alleviate a person's dependence upon someone else to be able to perform the necessary activities to optimize their home rehabilitation.

One Version of the Invention Discussed Here Includes:

1. Base 18: a 10 inch×40 inch×½ inch board with a cushioned proximal end (seat cushion 28) for weight bearing on sacrum/posterior, although the invention is not limited to these or any other measurements. This component also has built into it two vertical braces 25 on each side halfway down the board, running lengthwise with a ½" slot between to accommodate elevation board 22, 24.
2. Interchangeable second seat cushion 30, using a hinge mechanism to allow for right or left leg use and cushioned sacral/posterior weight bearing
3. Half foam roll or ankle padding 20 for heel to rest upon attached to board via Velcro™ (or any other known means of attachment), making it removable. Roll is 10"×4".
4. 4 hooks—2 proximal and 2 distal to vertical support braces
5. Pulley cabling 39 (which includes rope, wire, string, or any other cabling) with handles and 2 foam cushions.
6. Thigh Support board for flexion stretching
7. Pulleys 29, cushion(s), and cabling/rope for flexion stretching
8. 2 hooks attached to flexion thigh support
9. Elevation board 22, 24, which may be adjustable in height/length. For example, boards 22, 24 may be slidably connected along sliders and may be lockable in one more height/length positions by any means known to lock, such as via clips, grooves, pins through holes, etc.
10. Board with 2 eye-bolts 34, attached to end of board with any flexible or stretchable material (such as Theraband™) attached to the eye-bolts 34 to support a foot sling 36, configured to support a foot and/or heel.
11. 2 vertical support braces on each side of base board to support flexion platform and also elevation board
12. 3-12"×14" platform step up boards, 33, attachable to distal end of base, 18.

Relationship Between the Components in One Embodiment

Referring to the figures, the foam half roll or ankle padding 20 is connected to the distal end of the base component for heel rest, allowing the lower extremity to be suspended in air, but in near horizontal position. The extension pulley system, attached to the base via j-bolts, is used to impart a self-controlled downward force upon the knee joint.

The thigh support component (which may comprise elevation boards 22, 24 with padding 38) is attached to the base by sliding it into the slots 26 created within the supports/braces 25. The length of the thigh support is adjusted for users' leg length prior to applying to the base 18. The thigh can be strapped to the thigh support for additional stabilization if preferred, by securing Velcro™ strap (or any other strapping or connection known in the art) around the thigh and support. The lower leg is free of restraint and able to move into full knee flexion as the knee allows. The knee flexion pulley system is applied by placing a cushion or padded interface 37 on the shin and pulley ropes within J-screws attached to the side of the thigh support. By pulling on the rope handles, the user imparts a downward force upon the lower leg, creating knee flexion movement.

The user can elevate the lower extremity for swelling control by removing the flexion thigh support and inserting an elevation component or cushioned platform 14 into the same braces 25 on the base component 18. The distal end of the elevation component is secured to the end of the base board by placing the adjustable hinged support (comprising elevation boards 22, 24) up against the platform holding the half foam heel support or ankle pad 20, which is secured to the distal end of the base board. The length of the distal hinged support can be adjusted to alter the angle of elevation desired.

The adjustable platform 27 can be secured to the distal end of the base board via Velcro™ strips (or any other known attachment means) between the bottom of the platform 27 and the top of the distal end of base 18 to allow the user to perform forward step-up strengthening exercises. This platform system is adjustable by securing each 2" thick (or any other thickness) platform unit 33 to the other via mechanical clasping mechanisms, allowing the user to increase the height of the platform as needed to progress the exercise.

A 0-90 degree knee flexion hamstring strengthening can be performed by putting the knee flexion thigh support in place, sliding the proximal end of board under a bed frame until it abuts the frame. The top platform has 8" (or any other size) eye-bolts secured to it, in which a resistance band (such as a spring-loaded or rubber material) is attached, creating a sling. The user is able to place heel into this sling while sitting on bed and perform resisted hamstring strengthening.

How the Invention Works:

The device is set up for the correct lower extremity by changing the cushioned seat component to align the base board appropriately. The base component is used for self knee flexion stretching by placing the thigh support component into the slots on the vertical braces on the base board. The user then lies on the base component with his posterior thigh resting on the thigh support. The knee flexion pulley is then used to impart a knee flexion force to the extremity by using upper extremities to pull, creating a downward directed force to lower leg.

A knee extension stretch can be effected by lying the involved lower extremity on the base component with heel resting on the ankle padding 20 at the distal end of the base component. A downward directed force is applied to the lower extremity above and below the knee joint via the pulley component that is attached to eye-bolts/eye-hooks on the base component. The user simply pulls on the pulley handles creating the desired knee extension stretch.

The hamstring strengthening exercise can be performed by placing the heel within the sling created by the resistance band tied between the eye-bolts that are attached to the platform attached on the distal end of base component. The user can either do this in the reclined position with the lower extremity stabilized on the thigh support component or by sliding the proximal end of the base component under a bed until the thigh support abuts the bed frame, then sitting on the bed and placing the heel into the resistance band sling and pulling toward the bed into knee flexion.

Progressive step-up exercises can be performed by simply lying the base component on a flat surface such as a floor and with the platform component attached to the distal end of the base component via Velcro™ (or any other connection means), the user steps up and down to exercise the involved extremity. The height is easily adjusted by adding or taking away platform units, which attach to each other via a secure clasping mechanism.

The icing/elevation board component is added to the base component via the vertical bracing on the base component and an adjustable distal hinged board that props against the proximal end of the attached platform component. The angle of elevation can be adjusted by lengthening/shortening this component, which may comprise two boards 22, 24 attached to one another via Velcro™ (or any other attachment means), allowing the length of this component to be adjusted, thus altering the angle of the elevation board component. The elements of the present invention may comprise wood, plastic, metal, or any other known material.

How to Use the Invention

The user would simply lie in a reclined position on his back or semi-reclined with trunk partially propped up. The user's involved leg is placed on the base component with heel placed on foam support or ankle padding. The extension pulley is attached to the base board and to the leg above and below the knee. The user then simply uses the pulley handles to impart an extension directed force.

To work now on knee flexion stretching, the user detaches the extension pulleys, places the thigh support component to the base board. The thigh support simply slides in the slot provided by vertical support portion of base board. The user then places a back of the involved thigh next to the thigh support, and attaches the flexion pulley mechanism, to thigh support and involved lower leg. The user simply uses a handle to impart a flexion directed force to the knee for stretching.

To perform hamstring strengthening, the user leaves the thigh support component in place, slides a proximal portion of the base component under a bed until the thigh component abuts the bed frame. Then, the platform with resistance band sling is attached to the distal end of the base component. The user then, sitting on the side of the bed, places his heel in the sling and pulls the knee into flexion exercising hamstring musculature.

To use the platform for the step-up exercise, the user places the platform at distal end of the base component and performs the step-up exercise. The height of the step can be adjusted by adding additional platform components and securing them by the clasping mechanism. The elevation component can be used by attaching it to the base board at the vertical support and secured distally by propping it against the proximal end of platform component. The user simply rests the involved leg upon the elevation board, able to use the icing component as desired.

Referring now to the drawings, an adjustable stretching system for stretching a leg of a user comprises: a base 18; an adjustable elevation board 22, 24 configured to be adjustable in length; a seat cushion attached to the base 28, 30; and a cushioned platform 12 connectable to the base 18, wherein the adjustable elevation board 22, 24 is configured to be connected between the base 18 and the cushioned platform 12. The base 18 may comprise any solid material, such as wood, plastic, or metal. The elevation board 22, 24 may comprise any extendable apparatus that can be adjusted in length and locked in place by any means known. The platform 12 need not be cushioned. The adjustable elevation board 22, 24 may comprise at least a first elevation board 22 and a second elevation board 24 slidably connected to each other and configured to be locked relative to each other.

In one embodiment, the invention further comprises: a first padded interface 44 configured to interface with a first leg region of the user just below a knee of the user; a second padded interface 45 configured to interface with a second leg region of the user just above a knee of the user; a first cabling 46 connected to the first padded interface 44 and configured to be pulled by the user; a second cabling 47 connected to the second padded interface 45 and configured to be pulled by the user; and an ankle pad 20 connectable to the base 18 and configured to support an ankle of the user when the first and second padded interfaces 44, 45 are interfacing with the first and second leg regions, respectively, of the user.

In one embodiment, the invention further comprises: a padding 38 connectable to the elevation board 22, 24; a padded interface 37 configured to interface with a lower leg region of the user; and a cabling 39 connected to the padded interface and configured to be pulled by the user. Padding 38 simply increases comfort of the user with his leg overhanging the elevation board 22, 24.

The cablings 46, 47, 39 may comprise rope, cable, wire, etc., made of any suitable material, such as metal, plastic, fabric, etc. The first and second cablings 46, 47 may be the same cabling. The interfaces 44, 45, 37 comfortably press against the user's leg and are connected to the cabling 46, 47, 39; they may comprise, for example, cylindrical padding or cushions wrapped around cabling 46, 47, 39, or may comprise slings or wrappings or any other apparatus for comfortably pulling on the user's leg via cabling 46, 47, 39.

In one embodiment, the invention further comprises a foot sling 36 stretchably connected to the base 18 and configured so that when a foot of the user is in the foot sling 36 and the user pulls the cabling, the foot sling 36 resists pulling by the user. The sling 36 may be made of any material, such as cloth, plastic, or rubber, and the stretchable connection may be via rubber bands, springs, or any other known means.

In one embodiment, the invention further comprises a brace 25 connected to the base 18 and configured to support the elevation board 22, 24 in a substantially vertical position or slanted position. The brace(s) 25 may comprise any structure allowing the board 22, 24 to be held upright.

In one embodiment, the invention further comprises a step-up platform 27 connectable to the base and comprising a plurality of independently connectable platform units 33, which may have a thickness of 1-3" each, allowing a user to stack them as desired.

In one aspect, a method of stretching the leg of the user comprises: providing the adjustable stretching system as described herein; connecting the elevation board 22, 24 to the base 18; connecting the cushioned platform 12 to the base 18 and the elevation board 22, 24; adjusting the length of the elevation board 22, 24 so as to adjust an angle of inclination of the cushioned platform 12; resting a posterior or bottom of the user on the seat cushion 28, 30 and resting the leg of the user on the cushioned platform 12.

In one aspect, a method of stretching the leg of the user comprises: providing the adjustable stretching system as described; connecting the elevation board 22, 24 to the base 18 via brace 25; connecting the padding 38 to the elevation board 22, 24; adjusting the length of the elevation board 22, 24 so as to adjust a height of the padding 38; resting a posterior or bottom of the user on the seat cushion 28, 30 and draping the leg of the user over the elevation board 22, 24 so that the leg is supported by contact of the padding 38 against the backside or an opposing region of a knee of the user; interfacing the padded interface 37 with the lower leg region of the user; and pulling the cabling 39 so as to stretch the leg at the knee.

In one aspect, a method of stretching the leg of the user comprises: providing the adjustable stretching system as described; resting a posterior or backside of the user on the seat cushion 28, 30 and resting the ankle on the ankle pad 20; interfacing the first padded interface 44 with the first leg region; interfacing the second padded interface 45 with the second leg region; and pulling the single cabling 46, 47 to thereby stretch the leg at the knee.

It should be understood, of course, that the foregoing relates to exemplary embodiments of the invention and that modifications may be made without departing from the spirit and scope of the invention.

What is claimed is:

1. An adjustable stretching system for stretching a leg of a user, comprising:

a base having a front end and a rear end;

a seat cushion attached to the base near the rear end;

a padded interface configured to interface with a lower leg region of the user;

an adjustable elevation board configured to be adjustable in length and comprising a bottom end and a top end, wherein the adjustable elevation board protrudes from the base at the bottom end, wherein at least the bottom end is oriented on the base in between the seat cushion and the padded interface;

a padding connectable to at least the top of the elevation board; and a cabling connected to the padded interface running from the padded interface to near the rear end of the base and configured to be pulled by the user.

2. The adjustable stretching system as claimed in claim 1, further comprising a foot sling stretchably connected to the base near the front end and configured so that when a foot of the user is in the foot sling and the user pulls the cabling, the foot sling resists pulling by the user.

3. The adjustable stretching system as claimed in claim 1, further comprising a brace connected to the base and configured to support the elevation board in a substantially vertical position.

4. The adjustable stretching system as claimed in claim 1, further comprising a step-up platform connectable to the base near the front end and comprising a plurality of independently connectable platform units.

5. The adjustable stretching system as claimed in claim 1, wherein the adjustable elevation board comprises at least a first elevation board and a second elevation board slidably connected to each other and configured to be locked relative to each other.

6. A method of stretching a leg of a user, comprising:

providing an adjustable stretching system comprising:

a base having a front end and a rear end;

a seat cushion attached to the base near the rear end;

a padded interface configured to interface with a lower leg region of the user;

an adjustable elevation board configured to be adjustable in length, wherein the adjustable elevation board comprises a top and a bottom;

a padding; and a cabling connected to the padded interface running from the padded interface to near the rear end of the base and configured to be pulled by the user;

connecting the bottom of the elevation board to the base in between the seat cushion and the padded interface;

connecting the padding to the top of the elevation board;

adjusting the elevation board so as to adjust a height of the padding;

resting a posterior of the user on the seat cushion and draping the leg of the user over the elevation board so that the leg is supported by contact of the padding against an opposing region of a knee of the user;

interfacing the padded interface with the lower leg region of the user; and pulling the cabling so as to stretch the leg at the knee.

* * * * *